US005437806A

United States Patent [19]

Bryant et al.

[11] Patent Number: 5,437,806

[45] Date of Patent: * Aug. 1, 1995

[54] ELECTRORHEOLOGICAL FLUIDS CONTAINING POLYANILINES

[75] Inventors: Charles P. Bryant, Euclid; Kasturi Lal, Willoughby; Joseph W. Pialet, Euclid, all of Ohio

[73] Assignee: The Lubrizol Corporation, Wickliffe, Ohio

[ * ] Notice: The portion of the term of this patent subsequent to Jul. 25, 2012 has been disclaimed.

[21] Appl. No.: 167,592

[22] Filed: Dec. 14, 1993

Related U.S. Application Data

[63] Continuation-in-part of Ser. No. 774,398, Oct. 10, 1991, abandoned.

[51] Int. Cl.[6] ..... C10M 171/00; C10M 169/04

[52] U.S. Cl. ..... 252/77; 252/73; 252/572

[58] Field of Search ..... 252/77, 73, 572

[56] References Cited

U.S. PATENT DOCUMENTS

| | | | |
|---|---|---|---|
| 2,417,850 | 3/1947 | Winslow | 175/320 |
| 3,047,507 | 7/1962 | Winslow | 252/75 |
| 3,367,872 | 2/1968 | Martinek et al. | 252/74 |
| 3,397,147 | 8/1968 | Martinek | 252/78 |
| 3,427,247 | 2/1969 | Peck | 252/75 |
| 3,984,339 | 10/1976 | Takeo et al. | 252/74 |
| 4,033,892 | 7/1977 | Stangroom | 252/76 |
| 4,645,614 | 2/1987 | Goossens et al. | 252/75 |
| 4,668,417 | 5/1987 | Goossens et al. | 252/75 |
| 4,687,589 | 8/1987 | Block et al. | 252/73 |
| 4,702,855 | 10/1987 | Goossens et al. | 252/75 |
| 4,737,886 | 4/1988 | Pedersen | 361/225 |
| 4,744,914 | 5/1988 | Filisko et al. | 252/74 |
| 4,772,407 | 9/1988 | Carlson | 252/74 |
| 4,879,056 | 11/1989 | Filisko et al. | 252/74 |
| 4,994,198 | 2/1991 | Chung | 252/78.3 |
| 5,108,639 | 4/1992 | Block et al. | 252/77 |
| 5,171,478 | 12/1992 | Hau | 252/500 |

FOREIGN PATENT DOCUMENTS

| | | |
|---|---|---|
| 191585 | 8/1986 | European Pat. Off. . |
| 0298746 | 1/1989 | European Pat. Off. . |
| 298746 | 1/1989 | European Pat. Off. . |
| 319201 | 6/1989 | European Pat. Off. . |
| 361106 | 4/1990 | European Pat. Off. . |
| 361931 | 4/1990 | European Pat. Off. . |

(List continued on next page.)

OTHER PUBLICATIONS

Gow et al, "The Electrorheological Properties of Polyaniline Suspensions", J. Colloid and Interface Science, vol. 136, No. 1, Apr. 1990, pp. 175–188.

(List continued on next page.)

*Primary Examiner*—Christine Skane

*Attorney, Agent, or Firm*—David M. Shold; Frederick D. Hunter, Sr.

[57] ABSTRACT

Non-aqueous electrorheological fluids are described which comprise a major amount of a hydrophobic liquid phase and a minor amount of a dispersed particulate phase of a polyaniline prepared by polymerizing aniline in the presence of an oxidizing agent and from about 0.1 to about 1.6 moles of an acid per mole of aniline to form an acid salt of polyaniline, and thereafter treating the acid salt with a base. The polyanilines may be prepared from aniline or from mixtures of aniline and other monomers such as pyrroles, vinyl pyridines, vinyl pyrrolidones, thiophenes, vinylidene halides, phenothiazines, imidazolines, N-phenyl-p-phenylene diamines or mixtures thereof. The electrorheological fluids prepared in accordance with the present invention are useful in a variety of applications including flotational coupling devices such as clutches for automobiles or industrial motors, transmissions, brakes or tension control devices; and linear damping devices such as shock absorbers, engine mounts and hydraulic actuators.

55 Claims, No Drawings

FOREIGN PATENT DOCUMENTS

| | | |
|---|---|---|
| 374525 | 6/1990 | European Pat. Off. . |
| 387857 | 9/1990 | European Pat. Off. . |
| 393831 | 10/1990 | European Pat. Off. . |
| 394005 | 10/1990 | European Pat. Off. . |
| 394049 | 10/1990 | European Pat. Off. . |
| 0395359 | 10/1990 | European Pat. Off. . |
| 406853 | 1/1991 | European Pat. Off. . |
| 0432601 | 6/1991 | European Pat. Off. . |
| 0432929 | 6/1991 | European Pat. Off. . |
| 0453614 | 10/1991 | European Pat. Off. . |
| 63-97694 | 4/1988 | Japan . |
| 226633 | 1/1990 | Japan . |
| 333194 | 2/1991 | Japan . |
| 3-139598 | 6/1991 | Japan . |
| 3139598 | 6/1991 | Japan . |
| 2184738 | 7/1987 | United Kingdom . |
| 2189803 | 11/1987 | United Kingdom . |
| 2199336 | 7/1988 | United Kingdom . |
| 2230532 | 10/1990 | United Kingdom . |
| 9000583 | 1/1990 | WIPO . |
| WO9001775 | 2/1990 | WIPO . |
| 90/10297 | 9/1990 | WIPO . |
| WO9111480 | 8/1991 | WIPO . |

OTHER PUBLICATIONS

Tan et al, J. Phys Chem. Solids 52 p. 673, 1991 no month available.

Cao et al, Polymer 30 p. 2305, 1989 no month available.

Armes et al, Synthetic Metals, 22 p. 385, 1988 no month available.

H. A. Pohl et al, J. Phys. Chem., 66, (1962), pp. 2085–2095.

Block and Kelly in I. Phys. D; Appl. Phys. 21 (1988) 1661–1677 no month available.

A. G. MacDiarmid et al in Conducting Polymers (L. Alcacer, Ed.), pp. 105–120, Reidel Dordrecht, 1986 no month available.

ELECTRORHEOLOGICAL FLUIDS CONTAINING POLYANILINES

This application is a continuation-in-part of application Ser. No. 07/774,398 filed on Oct. 10, 1991, now abandoned, the disclosure of which is incorporated herein by reference.

FIELD OF THE INVENTION

This invention relates to electrorheological fluids. More particularly, this invention relates to electrorheological fluids containing certain electronically conductive polymers as the dispersed particulate phase.

BACKGROUND OF THE INVENTION

Electrorheological(ER) fluids are dispersions which can rapidly and reversibly vary their apparent viscosity in the presence of an applied electric field. The electrorheological fluids are dispersions of finely divided solids in hydrophobic, electrically non-conducting oils and such fluids have the ability to change their flow characteristics, even to the point of becoming solid, when subjected to a sufficiently strong electrical field. When the field is removed, the fluids revert to their normal liquid state. Electrical DC fields and also AC fields may be used to effect this change. The current passing through the electrorheological fluid is extremely low. Thus, ER fluids are used in applications in which it is desired to control the transmission of forces by low electric power levels such as, for example, clutches, hydraulic valves, shock absorbers, vibrators or systems used for positioning and holding work pieces in position.

U.S. Pat. No. 2,417,508 (issued in 1947 to Willis M. Winslow) disclosed that certain dispersions composed of finely divided solids such as starch, carbon, limestone, gypsum, flour, etc., dispersed in a non-conducting liquid such as a lightweight transformer oil, olive oil or mineral oil, etc., would undergo an increase in flow resistance when an electrical potential difference was applied to the dispersion. This observation has been referred to as the Winslow Effect. Subsequently, investigators demonstrated that the increase in the flow resistance was due not only to an increase in the viscosity, in the Newtonian sense, but also to rheological changes in which the fluid displays a positive yield stress in the presence of an electric field. This relationship is often described using the Bingham plastic model. Yield stress is the amount of stress which must be exceeded before the system moves or yields. The yield stress is a function of electric field and has been reported to be linear or quadratic, depending on fluid composition and the experimental techniques. Measurement of yield stress can be achieved by extrapolation of stress vs. strain curves, sliding plate, controlled stress, or capillary rheometers.

The efficiency of the electrorheological fluid is related to the amount of electrical power required to affect a given change in rheological properties. This is best characterized as the power required for an observed ratio of yield stress under field to the viscosity of the fluid in the absence of a field. From fluid requirements vs. device design considerations, a parameter has been defined as the dimensionless Winslow number, Wn, where;

$$Wn = \frac{(YS)^2}{(PD)(\eta o)}$$

$YS$ = Yield stress (Pa)

$PD$ = Power density (w/m$^3$)
= Current density × Field strength $\eta o$ = Viscosity with no field applied (PaS)

Electrorheological fluids which have been described in the literature can be classified into two general categories: water containing; and those which do not require water. Although fluids were known to function without water, for many years, it was believed that ER fluids had to contain small quantities of water which were believed to be principally associated with the dispersed phase to exhibit significant ER properties. However, from an application standpoint, the presence of water generally is undesirable since it may result in corrosion, operating temperature limitations (loss of water at higher temperatures), and significant electrical power consumption.

The present invention is concerned primarily with the preparation of ER fluids which do not contain significant amounts of water and these are hereinafter termed non-aqueous or substantially anhydrous ER fluids. Several patents and publications in the last five years have described non-aqueous ER fluids in which electronically conductive polymers have been utilized as the dispersed particulate phase. U.S. Pat. No. 4,687,589 (Block et al) describes an electrorheological fluid which comprises a liquid continuous phase and, dispersed therein, at least one dispersed phase which is capable of functioning as such when at least the dispersed phase is substantially anhydrous. Preferably, the ER fluid is one which is capable of functioning as such when the fluid itself is substantially anhydrous. The term "anhydrous" in relation to the dispersed phase is defined as the phase obtained after catalyst removal, which is dried under vacuum at 70° C. for three days to a constant weight. In relation to the continuous phase, an anhydrous continuous phase is defined as the phase dried by passage, at an elevated temperature (for example, 70° C.) if required, through an activated alumina column. The dispersed phase described in this patent is an electronic conductor which is a material through which electricity is conducted by means of electrons (or holes) rather than by means of ions. Examples of such phases include semi-conductors, particularly organic semi-conductors. The semi-conductors are defined as materials having an electric conductivity at ambient temperature of from $10^0$ to $10^{-11}$ mho/cm and a positive temperature-conductivity coefficient. The organic semi-conductors described in this patent include materials which comprise an unsaturated fused polycyclic system such as violanthrone B. The aromatic fused polycyclic systems may comprise at least one heteroatom such as nitrogen or oxygen. Phthalocyanine systems such as a metallophthalocyanine systems are particularly preferred. Another class of electronic conductors described in this patent include fused polycyclic systems such as poly(acene-quinone) polymers which may be prepared by condensing at least one substituted or unsubstituted acene such as by phenyl, terphenyl, naphthylene, etc., with at least one substituted or unsubstituted polyacylated aromatic compound such as a substituted or unsubstituted aromatic polycarboxylic acid in the presence of a Lewis acid such as zinc chloride. Schiff's Bases are also described as suitable organic semi-conductors. The Schiff's Bases may be prepared by reacting polyisocyanates with quinones. Aniline black, prepared, for example, by oxidizing aqueous aniline hydrochloride with sodium chlorate is another example of such an organic semi-conductor. The patentees also indicate that other classes of suitable organic semi-conductors are described by H. A. Pohl et al in J. Phys. Chem., 66, (1962) pp. 2085–2095.

More recently, the use of polyaniline suspensions as electrorheological fluids was described by Gow and Zukowski in tithe Electrorheological Properties of Polyaniline Suspensions", J. Colloid and Interface Science, Vol. 126, No. 1, April 1990, pp. 175–188. The authors describe the electrorheological properties of suspensions containing polyaniline particles in silicon oil for a range of suspension volume fractions, applied field strengths, shear stresses, and particle dielectric constants. The polyaniline utilized in the studies was synthesized by adding aniline to chilled aqueous hydrochloric acid followed by the addition of an aqueous ammonium peroxy, disulfate solution of the same temperature. The initial reactant concentrations were 0.55 mole aniline, 0.1 mole of the ammonium peroxydisulfate and one mole of hydrochloric acid. The polyaniline solids obtained in this manner were divided into four portions, and an aqueous suspension was prepared from each portion and adjusted with sodium hydroxide to a desired pH (i.e., 6,7,8 and 9). The pH of the suspensions was adjusted over a period of days until they remained constant for 24 hours. The hydrophobic powders were then recovered and washed. The authors concluded that suspensions composed of the polyaniline particles in polydimethyl silicone showed a substantial ER response.

In European patent application 394,005 (corresponding to GB 2,230,532) published on Oct. 24, 1990, Block et al describe an electrorheological fluid which consists of silicone oil containing 30 volume percent of dispersed polyaniline. The polyaniline is acidically oxidized aniline prepared by adding aniline (1.2 moles) to a continuously stirred and cooled solution (0°–5° C.) of ammonium persulfate (1.2 moles) in 1500 ml. of 2M hydrochloric acid solution. After drying and grinding, the black polyaniline powder was treated with sodium or ammonium hydroxide in different amounts and for different periods of time. The base-treated polyanilines prepared in this manner were reported to be useful in ER fluids.

European Patent Application 387857 (published Sep. 19, 1990) describes ER fluids comprising an insulated liquid and solid electrolyte particles which may be various inorganic materials or organic polymers. Alkali metal salts of polyethylene oxide complexes and alkali halide-crown ether complexes are given as examples of such polymers.

Japan Hei 3-33194 published Feb. 13, 1991 describes electrorheological fluids containing dispersed organic polymers. The polymers described in this publication are polypyrrole, polydibromothiophene and poly-p-phenylene.

Japan 3139598, published Jun. 13, 1991, describes ER fluids containing organic conductive polymers and electrically insulating oils. The conductive polymer is preferably obtained by subjecting a polymer, obtained by oxidation polymerization, to a dope-removing treatment, or a polymer obtained by treating polyaniline with alkali. Preferably the powder has an insulating layer on its surface. Preferred polymers include polyaniline, polypyrrole, polythiophene and their derivatives

SUMMARY OF THE INVENTION

Non-aqueous electrorheological fluids are described which comprise a hydrophobic liquid phase and a dispersed particulate phase of a polyaniline prepared by polymerizing aniline in the presence of an oxidizing agent and from about 0.1 to about 1.6 moles of an acid per mole of aniline to form an acid salt of polyaniline, and thereafter treating the acid salt with a base. The polyanilines may be prepared from aniline or from mixtures of aniline and other monomers such as pyrroles, vinyl pyridines, vinyl pyrrolidones, thiophenes, vinylidene halides, phenothiazines, imidazolines, N-phenyl-p-phenylene diamines or mixtures thereof. The electrorheological fluids prepared in accordance with the present invention are useful in a variety of applications including flotational coupling devices such as clutches for automobiles or industrial motors, transmissions, brakes or tension control devices; and linear damping devices such as shock absorbers, engine mounts and hydraulic actuators.

DETAILED DESCRIPTION OF THE INVENTION

Unless otherwise specified in the disclosure and claims, the following definitions are applicable. The term "hydrocarbyl" denotes a group or substituent having a carbon atom directly attached to the remainder to the molecule and having predominantly hydrocarbon character.

Examples of hydrocarbyl groups or substituents which can be useful in connection with the present invention include the following:

(1) hydrocarbon groups or substituents, that is aliphatic (e.g., alkyl or alkenyl), alicyclic (e.g., cycloalkyl, or cycloalkenyl) substituents, aromatic, aliphatic and alicyclic-substituted aromatic nuclei and the like, as well as cyclic substituents wherein the ring is completed through another portion of the molecule (that is, for example, any two indicated substituents may together form an alicyclic group);

(2) substituted hydrocarbon groups or substituents, that is, those containing nonhydrocarbon substituents which, in the context of this invention, do not alter the predominantly hydrocarbon character of the substituted group or substituent and which do not interfere with the reaction of a component or do not adversely affect the performance of a material when it is used in an application within the context of this invention; those skilled in the art will be aware of such groups (e.g., alkoxy, carbalkoxy, alkylthio, sulfoxy, etc.);

(3) hetero groups or substituents, that is, groups or substituents which will, while having predominantly hydrocarbon character, contain atoms other than carbon present in a ring or chain otherwise composed of carbon atoms. Suitable heteroatoms will be apparent to those of ordinary skill in the art and include, for example, sulfur, oxygen, and nitrogen. Moieties such as pyridyl, furanyl, thiophenyl, imidazolyl, and the like, are exemplary of hetero groups or substituents. Up to two heteroatoms, and preferably no more than one, can be present for each 10 carbon atoms in the hydrocarbon-based groups or substituents.

Typically, the hydrocarbon-based groups or substituents of this invention are essentially free of atoms other than carbon and hydrogen and are, therefore, purely hydrocarbon.

Hydrophobic Liquid Phase

The non-aqueous electrorheological fluids of the present invention comprise a hydrophobic liquid phase which is a non-conducting, electric insulating oil or an oil mixture. Examples of insulating oils include silicone oils, transformer oils, mineral oils, vegetable oils, aromatic oils, paraffin hydrocarbons, naphthalene hydrocarbons, olefin hydrocarbons, chlorinated paraffins, synthetic esters, hydrogenated olefin oligomers, and mixtures thereof. The choice of the hydrophobic liquid phase will depend in part upon the intended utility of the ER fluid. For example, the hydrophobic liquid should be compatible with the environment in which it will be used. If the ER fluid is to be in contact with elastomeric materials, the hydrophobic liquid phase should not contain oils or solvents which attack or swell, or, in some cases even dissolve elastomeric materials. Additionally, if the ER fluid is to be subject to a wide temperature range of, for example, from about −50° C. to about 150° C., the hydrophobic liquid phase should be selected to provide a liquid and chemically stable ER fluid over this temperature range and should exhibit an adequate electrorheological effect over this temperature range. Suitable hydrophobic liquids include those which are characterized as having a viscosity at room temperature of from about 2 to about 300 centipoise. In another embodiment, low viscosity oils such as those having a viscosity at room temperature of from 2 to about 20 centipoises are preferred.

Liquids useful as the hydrophobic continuous liquid phase generally are characterized as having as many of the following properties as possible: (a) high boiling point and low freezing point; (b) low viscosity so the ER fluid has a low no-field viscosity and greater proportions of the solid dispersed phase can be included in the fluid; (c) high electrical resistance and high dielectric strength so that the fluid will draw little current and can be used over a wide range of applied electric field strengths; and (d) chemical and thermal stability to prevent degradation on storage and service.

Oleaginous liquids such as petroleum derived hydrocarbon fractions may be utilized as the hydrophobic liquid phase in the ER fluids of the invention. Natural oils are useful and these include animal oils and vegetable oils (e.g., castor, lard oil, sunflower oil) liquid petroleum oils and hydrorefined, solvent-treated or acid-treated mineral lubricating oils of the paraffinic, naphthenic and mixed paraffinic-naphthenic types. Oils derived from coal or shale are also useful oils.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g.,phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols and polyols e.g., butyl alcohol, hexyl alcohol, dodecyl alcohol, 2-ethylhexyl alcohol, ethylene glycol, diethylene glycol, monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Polyalpha olefins and hydrogenareal polyalpha olefins (referred to in the art as PAO) are useful in the ER fluids of the invention. PAOs are derived from alpha olefins containing from 2 to about 24 or more carbon atoms such as ethylene, propylene, 1-butene, isobutene, 1-decene, etc. Specific examples include polyisobutylene having a number average molecular weight of 650; a hydrogenated oligomer of 1-decene having a viscosity at 100° C. of 8 cst; ethylene-propylene copolymers; etc. An example of a commercially available hydrogenated polyalphaolefin is Emery 3004.

Silicon-based oils such as the polyalkyl-, polyaryl-, polyalkoxy-, or polyaryloxysiloxane oils and silicate oils comprise a particularly useful class of synthetic oils. These oils include tetraethyl silicate, tetraisopropyl silicate, tetra-(2-ethylhexyl) silicate, tetra-(4-methyl-2-ethylhexyl) silicate, tetra-(p-terbutylphenyl) silicate, hexa-(4-methyl-2-pentoxy) disiloxane, poly(methyl) siloxanes and poly(methylphenyl) siloxanes. The silicone oils are useful particularly in ER fluids which are to be in contact with elastomers.

Other synthetic oils include liquid esters of phosphorus-containing acids such as tricresyl phosphate, trioctyl phosphate and the diethyl ester of decylphosphonic acid.

Specific examples of hydrophobic liquids which may be utilized in the ER fluids of the present invention include, for example, mineral oil, di-(2-ethylhexyl) adipate; di-(2-ethylhexyl)maleate; dibenzylether, dibutylcarbitol; di-2-ethylhexyl phthalate; 1,1-diphenylethane; tripropylene glycol methyl ether; butyl cyclohexyl phthalate; di-2-ethylhexyl azelate; tricresyl phosphate; tributyl phosphate; tri(2-ethylhexyl) phosphate; pentachlorophenyl phenyl ether; brominated diphenyl methanes; olive oil; xylene; toluene, etc. Commercially available oils which may be used in the ER fluids of the invention include: Trisun 80, a high oleic sunflower oil from The Lubrizol Corporation; Emery 3004, a hydrogenated polyalpha olefin; Emery 2960, a synthetic hydrocarbon ester; and Hatco HXL 427, believed to be a synthetic ester of a monocarboxylic acid and a polyol.

The amount of hydrophobic liquid phase in the ER fluids of the present invention may range from about 20% to about 90 or 95% by weight. Generally, the ER fluids will contain a major amount of the hydrophobic liquid, i.e., at least 51% by weight. More often, the hydrophobic liquid phase will comprise from about 60 to about 80 or 85% by weight of the ER fluid.

The Polyaniline Dispersed Particulate Phase

The polyaniline powders which may be utilized as the dispersed particulate phase in the ER fluids of the present invention are prepared by polymerizing aniline in the presence of an oxidizing agent and from about 0.1 to about 2 moles, more preferably up to about 1.6 moles and more preferably about one mole of an acid per mole of aniline to form an acid salt of polyaniline. Thereafter the acid salt is treated with a base. The polyanilines useful as the dispersed particulate phase in the ER fluid of the present invention may also be obtained by polymerizing the mixtures of aniline and up to about 50% by weight of another monomer selected from pyrroles, vinyl pyridines, vinyl pyrrolidones, thiophenes, vinylidene halides, phenothiazines, imidazolines, N-phenyl-p-phenylene diamines or mixtures thereof. For example, the polyaniline may be prepared from a mixture of aniline and up to about 50% by weight of pyrrole or a substituted pyrrole such as N-methylpyrrole and 3,4-dimethylpyrrole.

As noted, the polymerization is conducted in the presence of an oxidizing agent. Generally, the polymerization is accomplished in the presence of about 0.8 to about 2 moles of the oxidizing agent per mole of aniline. Various oxidizing agents may be utilized to effect the polymerization of the aniline, and useful oxidizing agents include, peroxides such as sodium peroxide, hydrogen peroxide, benzoyl peroxide, etc; alkali metal chlorates such as sodium chlorate and potassium chlorate; alkali metal perchlorates such as sodium perchlorate and potassium perchlorate; periodic acid; alkali metal iodates and periodates such as sodium iodate and sodium periodate; persulfates such as metal or ammonium persulfates; and chlorates. Alkali metal and alkaline earth metal persulfates may be utilized. The metal and ammonium persulfates, particularly alkali metal or ammonium persulfates are especially useful as the oxidizing agent.

Polymerization of the aniline, as noted above, also is conducted in the presence of an acid. In one embodiment, from about 0.1 to about 1.6 or even 2 moles of an acid may be used per mole of aniline or mixture of aniline and any of the comonomers described above. In another embodiment, from about 0.8 to about 1.2 moles of acid are utilized per mole of aniline, and in a preferred embodiment, the aniline is polymerized in the presence of approximately equimolar amounts of oxidizing agent and acid.

The acid which is utilized in the polymerization reaction may be an organic acid or an inorganic acid with the inorganic acids generally preferred. Examples of inorganic acids which are useful include mineral acids such as hydrochloric acid, sulfuric acid and phosphoric acid. Hydrochloric acid is one preferred example of an inorganic acid useful in the polymerization of the aniline.

Organic acids which may be used in the polymerization of aniline include, for example, sulfonic acids, sulfinic acids, carboxylic acids or phosphorus acids, and these acids may be alkyl or aryl-substituted acids. Partial salts of said acids also may be used. The organic acids may contain one or more of the sulfonic, sulfinic or carboxylic acid groups, and the acids may, in fact, be polymeric acids as described more fully below. Although the organic acids may contain olefinic unsaturation, it is generally preferred that the organic acids be saturated acids since organic acids containing olefinic unsaturation generally will react with the oxidizing agent thereby diminishing the amount of oxidizing agent available to effect oxidation of the aniline and the resulting polymerization reaction. Accordingly, when the organic acid contains olefinic unsaturation, an excess of the oxidizing agent is generally included in the polymerization mixture. Examples of sulfonic acids which may be utilized include alkyl sulfonic acids such as methane sulfonic acid, ethane sulfonic acid, propane sulfonic acid, hexane sulfonic acid and lauryl sulfonic acid. Examples of aromatic sulfonic acids include benzenesulfonic acid and para-toluenesulfonic acid. The organic phosphorus acids useful in the present invention include alkyl phosphonic acids (e.g., methylphosphonic acid, ethylphosphonic acid), aryl phosphonic acids (e.g., phenyl phosphonic acid), and alkyl phosphinic acids (e.g., dimethylphosphinic acid).

Examples of carboxylic acids include alkyl carboxylic acids such as propanoic acid, hexanoic acid, decanoic acid and succinic acid. Examples of aromatic carboxylic acids include benzoic acid.

In another embodiment, the organic acid utilized in a polymerization of aniline is a sulfo acid monomer (or polymer thereof) which may contain at least one sulfonic or sulfinic acid. Mixtures of sulfo acid monomers may be used. Acidic polymers prepared from sulfo acid monomers are preferred in the polymerization process of the present invention since the polymers contain little or no olefinic unsaturation. Specific examples of useful sulfo acid monomers (and polymers thereof) include vinyl sulfonic acid, ethane sulfonic acid, vinyl benzene sulfonic acid, vinyl naphthalene sulfonic acid, vinyl anthracene sulfonic acid, vinyl toluene sulfonic acid, methallyl sulfonic acid, 2-methyl-2-propene-1-sulfonic acid and acrylamidohydrocarbyl sulfonic acid.

A particularly useful acrylamidohydrocarbyl sulfo monomer is 2-acrylamido-2-methylpropane sulfonic acid. This compound is available from The Lubrizol Corporation, Wickliffe, Ohio, USA, under the trademark AMPS ® Monomer. Other useful acrylamidohydrocarbyl sulfo monomers include 2-acrylamidoethane sulfonic acid, 2-acrylamidopropane sulfonic acid, 3-methylacrylamidopropane sulfonic acid, and 1,1-bis(acrylamido)-2-methylpropane-2-sulfonic acid.

In one embodiment, the organic acid used in the polymerization reaction may be (a) a sulfo acid monomer represented by the formula $$(R_1)_2C{=}C(R_1)Q_aZ_b \qquad (I)$$

wherein each $R_1$ is independently hydrogen or a hydrocarbyl group; a is 0 or 1; b is 1 or 2, provided that when a is 0, then b is 1;

Q is a divalent or trivalent hydrocarbyl group or $C(X)NR_2Q'$;

each $R_2$ is independently hydrogen or a hydrocarbyl group;

Q' is a divalent or trivalent hydrocarbyl group;

X is oxygen or sulfur; and

Z is $S(O)OH$, or $S(O)_2OH$; or (b) a polymer of said monomer.

In Formula (I), $R_1$ and $R_2$ are each independently hydrogen or hydrocarbyl. In a preferred embodiment, $R_1$ and $R_2$ are each independently hydrogen or an alkyl group having from 1 to 12 carbon atoms, preferably to about 6, more preferably to about 4. In a preferred embodiment, $R_1$ and $R_2$ are each independently hydrogen or methyl, preferably hydrogen.

Q is a divalent or trivalent hydrocarbyl group or $C(X)NR_2Q'$. Q' is a divalent or trivalent hydrocarbyl group. The divalent or trivalent hydrocarbyl groups Q and Q' include alkanediyl (alkylene), alkanetriyl, arenylene (arylene) and arenetriyl groups. Preferably, Q is an alkylene group, an arylene group or $C(H)(NR_2)Q'$. The hydrocarbyl groups each independently contain from 1, preferably from about 3 to about 18 carbon atoms, preferably up to about 12, more preferably to about 6, except when Q or Q' are aromatic where they contain from 6 to about 18 carbon atoms, preferably 6 to about 12. Examples of di- or trivalent hydrocarbyl groups include di- or trivalent methyl, ethyl, propyl, butyl, cyclopentyl, cyclohexyl, hexyl, octyl, 2-ethylhexyl, decyl, benzyl, tolyl, naphthyl, dimethylethyl, diethylethyl, and butylpropylethyl groups, preferably a dimethylethyl group.

In one embodiment, Q is $C(X)NR_2Q'$ and Q' is an alkylene having from about 4 to about 8 carbon atoms, such as dimethylethylene.

In another embodiment, the acid is (b) a polymer derived from at least one sulfo acid monomer represented by Formula (I).

The polymers derived from the sulfo acid monomers generally are characterized as having sulfonic or sulfinic acid moieties extending from the backbone of the polymer. The polymers may also be derived from two or more different sulfo-acid moieties. Thus, the polymers may be copolymers or terpolymers of two or more of said sulfo acid monomers. In such instances one of the sulfo acid monomers may be a salt such as an alkali metal salt of the sulfo acid monomers. An example of a useful copolymer is the copolymer obtained from a mixture of 20 parts of AMPS monomer and one part of the sodium salt of 2-methyl-2-propene-1-sulfonic acid.

In another embodiment, the copolymers and terpolymers are prepared from (i) at least one sulfo acid monomer of Formula I and (ii) one or more comonomers selected from the group consisting of acrylic compounds; maleic acids, anhydrides or salts; vinyl lactams; vinyl pyrrolidones and fumaric acids or salts. The comonomer is preferably water soluble. Acrylic compounds include acrylamides, acrylonitriles, acrylic acids, esters or salts, methacrylic acids, esters or salts, and the like. Specific examples of these compounds include acrylamide, methacrylamide, methylenebis(acrylamide), hydroxymethylacrylamide, acrylic acid, methacrylic acid, methylacrylate, ethylacrylate, butylacrylate, 2-ethylhexylacrylate, hydroxyethylacrylate, hydroxybutylacrylate, methylacrylate, ethylacrylate, butylmethylacrylate, hydroxypropylmethacrylate, crotonic acid, methyl crotonate, butyl crotonate, hydroxyethyl crotonate. Alkali or alkaline earth metal (preferably sodium, potassium, calcium or magnesium) salts of acrylic, methacrylic or crotonic acids may also be used. Substituted and unsubstituted vinyl pyrrolidones and vinyl lactams, such as vinyl caprolactam, are useful as comonomers. Examples of useful maleic comonomers include alkali or alkaline earth metal salts of maleic acid (preferably sodium salts), $C_{1-6}$ alkyl esters (preferably methyl, ethyl or butyl), or ester-salts formed from $C_{1-6}$ alkyl esters and alkali or alkaline earth metals. Preferably, the monomers include acrylic or methacrylic acids, esters or salts. The comonomer is generally present in an amount from about 1%, more often from about 25% to about 75%. In one embodiment, about equal parts of the sulfo acid monomer and the comonomer are polymerized, more preferably about 50% by weight of the sulfo monomer or the comonomer.

The polymers are formed by polymerization of the sulfo monomers using conventional vinyl polymerization techniques. For solution polymerization, water is the preferred solvent for the preparation of the polymers of the present invention. Dimethylformamide is also suitable in many cases. Initiators used in the polymerization process are known to those in the art and include ammonium persulfate, hydrogen peroxide, redox initiators and organic soluble initiators such as azo-bis-isobutyronitrile.

The polymers may also be prepared in a high energy mechanical mixing means, such as an extruder or ball mill. The process using a high energy mechanical mixing means is described in U.S. Pat. No. 4,812,544 issued to Sopko et al. The process described therein is hereby incorporated by reference for its disclosure to making of polymers and copolymers with high energy mechanical mixing.

The sulfo polymers used in the present invention may have a viscosity average molecular weight to about 9,000,000, preferably to about 1,000,000. The polymers generally have viscosity average molecular weight of at least about 5,000, preferably at least about 10,000. In one preferred embodiment, the sulfo polymers have a viscosity average molecular weight of about 10,000 to 20,000.

The following examples A–C illustrate the preparation of sulfo acid polymers (or salts thereof) useful in the present invention. Unless otherwise indicated in the examples, and elsewhere in the specification and claims, temperature are in degrees Celsius, parts are parts by weight, and pressure is at or near atmospheric pressure.

EXAMPLE A

A monomer solution is prepared by mixing 43 parts (0.44 mole) of maleic anhydride with 666.5 parts (0.44 mole) of a 15% by weight solution of sodium 2-acrylamido-2-methylpropane sulfonate in dimethylformamide. The above monomer solution is added to a reaction vessel and heated to 60° C. under nitrogen. The reaction temperature is maintained at 60°–63° C. for 45 minutes where 0.6 part (0.004 mole) of azobis(isobutyronitrile) dissolved in 2.6 parts dimethylformamide is added to the reaction vessel. The reaction temperature is maintained at 60° C. for 19 hours. The reaction mixture is stripped to 80° C. and 10 millimeters of mercury to yield a clear viscous liquid. The product has an inherent viscosity of 0.039 $dLg^{-1}$ (0.25 part polymer in 100 parts 0.5 normal aqueous sodium chloride at 30° C.).

EXAMPLE B

A reaction vessel is charged with 67.7 parts (0.94 mole) of acrylic acid and 651 parts of dimethylformamide. Anhydrous sodium carbonate (49.8 parts, 0.47 mole) is added to the flask at 27° C. The slurry is stirred for 36 minutes at 25° C. The reaction temperature is increased to 40° C. and the mixture is stirred for three hours. A solution of 67.5 parts (0.69 mole) of maleic anhydride, 50 parts (0.065 mole) of a 30% solution of sodium 2-acrylamido-2-methylpropane sulfonate in dimethylformamide, and 75 parts dimethylformamide is added to the reaction vessel at 27° C. The reaction mixture is heated to 35° C. for 20 minutes. A solution of 0.5 parts of azobis(isobutyronitrile) in 3 parts dimethylformamide is added to the reaction vessel at 45° C. The reaction temperature increases exothermically to 70° C. over 20 minutes. The reaction temperature is maintained between 60°–63° C. for two hours. The reaction mixture is filtered and the filtrate is stripped at 80° C. and 10 millimeters of mercury. The residue has an inherent viscosity of 0.12 $dLg^{-1}$ (0.1077 part product in 100 parts 0.5 normal aqueous sodium chloride solution at 30° C.).

EXAMPLE C

A monomer solution is prepared by adding 414.4 parts (2 moles) of 2-acrylamido-2-methyl propane sulfonic acid and 15.8 (0.1 mole) parts of 2-methyl-2-propene-l-sulfonic acid, sodium salt to 990 parts of distilled water. The mixture is heated and purged with nitrogen to a temperature of about 60° C. whereupon the mixture of 10 parts of water and one part of 2,2'-azobis(2-amidinopropane) dihydrochloride is added. An exothermic polymerization reaction occurs, and the temperature reaches about 84° C. in about 10 minutes. The reaction mixture then cools to about 60° C. and stirring is continued for about 3 hours while maintaining the temperature at about 60° C. The mixture is then cooled and allowed to stand overnight. A pale-yellow liquid of the desired polymer acid is obtained having an acid neutralization number (to phenolphthalein) of 78.0 (theory, 78.4).

In one embodiment of the present invention, the polyaniline acid salts are prepared by adding an aqueous solution of the oxidizing agent to an aqueous mixture of aniline and optionally any of the comonomers mentioned above, and acid while maintaining the temperature of the reaction mixture below about 50° C. In a preferred embodiment, the temperature of the reaction is maintained below about 10° C., generally from about 0 to about 10° C. The polymerization reaction is generally completed in about 3 to 10 hours, although the reaction mixture is generally stirred for periods of up to 24 hours at room temperature after the initial reaction period. The polyaniline acid salts obtained in this manner generally are washed with water or slurried in water and/or an alcohol such as methanol for periods of up to 24 or even 48 hours and thereafter dried.

The polymerization of mixtures of aniline and other comonomers in accordance with the process of the present invention can be conducted in the presence of solid substrates which are generally inert materials such as silica, mica, talc, glass, alumina, zeolites, cellulose, organic polymers, etc. In these embodiments, the polymerized aniline generally is deposited on the substrate as a coating which may also penetrate into the open pores in the substrate. The substrates may be of any size and shape including irregular as well as regular shapes such as rods, spheres, etc.

In one particular embodiment of the present invention, the polymerization of aniline is conducted in the presence of a zeolite (e.g., Zeolite LZ-Y52, from the Linde division of Union Carbide and identified as $Na_{5.6}Al_{56}$, $Si_{136}O_{384}$) and cupric nitrate. The cupric nitrate is dissolved in water and the zeolite is added with stirring whereupon an exchange occurs. It is believed that copper atoms exchange for at least some of the sodium atoms in the zeolite. In the gas phase reaction with aniline, cupric ion is reduced to cuprous ion with the generation of an acid function, resulting in the formation of polyaniline within the skeletal structure and as a coating on the zeolite particle.

In another embodiment of the present invention, the polymerization of the aniline in the presence of acid and an oxidizing agent is conducted in the presence of cellulose particles which may be either in the form of fibers, spheres, rods, etc. The deposition of the polyaniline acid salts on the cellulose results in particles useful as the dispersed phase which may be designed to provide various and desired aspect ratios which can be utilized to control the shape of the dipole and separation of charge of the dispersed phase in the ER fluids. Examples of useful cellulose particles arc CF1 and CF11 available from Whatman Specialty Products Division of Whatman Paper Limited, Maidstone, Kent, ME 142LE. CF1 is identified as a long fibrous cellulose with a fiber length 100–400 μm and a mean diameter of 20–25 μm. CF11 is a medium fibrous cellulose with fiber length range of from 50–250 μm and a mean diameter of 20–25 μm.

Although the precise nature or structure of the polyaniline acid salts has not been determined, it is believed that under the oxidizing conditions used in the above-described reactions, the polymerization reaction results in a polyaniline characterized principally by the emeraldine structure. Some nigraniline structure may be present.

The acid salts of polyaniline prepared in accordance with the above procedures generally are treated with a base to remove protons from the acid salt, and reduce the conductivity of the polyaniline salt. The protons are those derived from the acid used in the polymerization reaction. Various basic materials may be utilized to deprotonate the acid salt. Generally, the base is ammonium hydroxide or a metal oxide, hydroxide, alkoxide or carbonate. The metal may be an alkali metal such as sodium or potassium or an alkaline earth metal such as barium, calcium or magnesium. When the base is ammonium hydroxide or alkali metal hydroxide or carbonate, aqueous solutions of the hydroxide and carbonate are utilized for reaction with the acid salt of polyaniline. When metal alkoxides are utilized for this purpose, the solvent or diluent is generally an alcohol. Examples of alkoxides which may be utilized include sodium methoxide, potassium ethoxide, sodium ethoxide, sodium propoxide, etc. Examples of alcohol include methanol, ethanol, propanol, etc.

In one embodiment, the metal carbonate used as the base may be an overbased or gelled overbased metal salt. Overbased metal salts are characterized by metal content in excess of that which would be present according to stoichiometry of metal in the particular organic compound reacted with the metal. Typically, a metal salt is reacted with an acidic organic compound such as a carboxylic, sulfonic, phosphorus, phenol or mixtures thereof. An excess of metal is incorporated into the metal salt using an acidic material, typically carbon dioxide. Gelled overbased metal salts are prepared by treating an overbased metal salt with a conversion agent, usually an active hydrogen-containing compound. Conversion agents include lower aliphatic carboxylic acids or anhydrides, water, aliphatic alcohols, cycloaliphatic alcohols, aryl aliphatic alcohols, phenols, ketones, aldehydes, amines and the like. The overbased and gelled overbased metal salts are known and described in U.S. Pat. No. 3,492,231 issued to McMillen which is hereby incorporated by reference for its disclosure to overbased and gelled overbased metal salts and processes for making the same.

The polyaniline acid salt obtained as described above is treated with an amount of a base for a period of time which is sufficient to remove the desired amount of protons from the acid salt. In one embodiment the acid salt may be treated with up to about 5 moles, more often about 2 moles, of base per mole of acid salt. For the purposes of this invention the term "acidic protons" refers to protons ($H^+$) which are attached to the nitrogen atom in the polyaniline. The protons may also be referred to as labile protons. The removal of protons (deprotonation) is required when the polyaniline acid salts prepared in accordance with the above procedures are too conductive to provide ER fluids having the desired characteristics. Thus, the degree of deprotonation will depend upon the conductivity of the polyaniline acid salt as formed and the ability of the polyaniline acid salt to perform in a particular ER fluid. The extent of the deprotonation desired can be readily determined by one skilled in the art by observing the effect of the deprotonated polyaniline acid salt when the salt is utilized as the dispersed phase in an ER fluid. It is generally believed that although it is desired to utilize conductive polymers as the dispersed phase in an ER fluid, the conductive composition is preferably a semi-conductor exhibiting minimal conductivity.

In one preferred embodiment, the polyaniline acid salts prepared in accordance with the process of the present invention are treated with an amount of the base for a period of time which is sufficient to remove substantially all of the protons derived from the acid. For example, if the acid utilized in the polymerization is hydrochloric acid, the polyaniline acid salt is treated with the base in an amount which is sufficient to reduce the chloride content of the acid salt to as low as from 0 to 0.2%.

It has been observed that the electronic conductivity characteristics of the polyaniline salts may be regulated and controlled more precisely by initially removing substantially all of the protons from the polyaniline acid salt obtained from the polymerization reaction, and thereafter treating the deprotonated polyaniline compound with an acid, a halogen, sulfur, sulfur halide, sulfur trioxide, or a hydrocarbyl halide to form a polyaniline compound having a desired conductivity. The level of conductivity obtained can be controlled by the selection of the type and amount of these compounds used to treat the polyaniline which is substantially free of acidic protons. The same procedure can also be used to increase the conductivity of polyaniline acid salts which have not been reacted with a base to the extent necessary to remove substantially all of the acidic protons. This treatment of the polyaniline with an acid, halogen, sulfur, sulfur halide, sulfur trioxide, or hydrocarbyl halide to form a polyaniline compound having a desired conductivity generally is known in the art as "doping".

Any of the acidic compounds described above as being useful reagents in the polymerization of aniline may be utilized as dopants. Thus, the acids may be any of the mineral acids or organic acids described above. In addition, the acid may be the Lewis acid such as aluminum chloride, ferric chloride, stannous chloride, boron trifluoride, zinc chloride, gallium chloride, etc.

The conductivity of the polyaniline can be increased also by treatment with a halogen such as bromine or iodine, or with a hydrocarbyl halide such as methyl iodide, methyl chloride, methyl bromide, ethyl iodide, etc., or with sulfur or a sulfur halide such as sulfur chlorides or sulfur bromides.

The polyaniline compounds which are substantially free of acidic protons are treated in accordance with the present invention with an amount of the above compounds which is sufficient to provide a desired conductivity as determined by the anticipated utility of the treated polyaniline. The desired conductivity of the treated product will depend in part upon the other components of the electrorheological fluid and the characteristics desired of the ER fluid. The characteristics, including the conductivity and theological properties of the ER fluid may be varied in part by variations in the conductivity of the dispersed particulate phase, the presence of non-conductive particles in the ER fluid, and the amount of the dispersed particulate phase in the ER fluid. In one embodiment, the polyaniline compounds which have been deprotonated are treated with hydrochloric acid in sufficient quantity to form a product containing up to about 5% chloride, more often up to about 1%.

The following examples illustrate the preparation of the polyaniline compounds useful as the conductive dispersed particulate phase in the non-aqueous ER fluids of the present invention.

EXAMPLE 1

Hydrochloric acid (166 ml., 2 moles) is diluted to two liters with distilled water in a five-liter flask, and 186 parts (2 moles) of aniline are added dropwise. In a separate vessel, 456 parts (2 moles) of ammonium persulfate are dissolved in 1400 ml. of water, and this solution is then added dropwise to the five-liter flask containing the aniline and hydrochloric acid while maintaining the temperature of the contents of the flask at between about 5° to 10° C. over a period of 5.5 hours with stirring. The mixture then is stirred for about 24 hours at room temperature. The contents of the reaction flask are filtered, and the residue is slurried with two liters of distilled water for one day and then filtered. The residue is slurried in two liters of methanol for one day and filtered. The polyaniline acid salt is obtained by drying the filtrate in a steam oven followed by drying in a vacuum oven at 150° C. The aniline salt obtained in this manner contained 3.11% chlorine, 11.89% nitrogen, 4.70% sulfur.

The above prepared hydrochloric acid salt is deprotonated in the following manner. Concentrated aqueous ammonium hydroxide (99 parts, 1.5 moles) is diluted to 3000 parts with distilled water in a five-liter flask, and 150 parts of the polyaniline hydrochloride salt are added slowly with stirring. When all of the salt has been added, the mixture is stirred for one day. The contents of the flask are filtered, and the filtrate is slurried with two liters of distilled water for one day. The desired product is recovered by filtration and is dried initially in a steam oven, screened and thereafter dried in a vacuum oven at 150° C. The product obtained in this manner contains 14.75% nitrogen (theory, 15.38) 0.19% sulfur and 0.49% chlorine.

EXAMPLE 2

Aqueous hydrochloric acid (124.5 parts, 1.5 moles) is added to one liter of distilled water in a five-liter flask, and 139.5 parts (1.5 moles) of aniline are added dropwise. In a separate vessel, 513 parts (2.25 moles) of ammonium persulfate are dissolved in 1400 ml. of distilled water, and this solution is added dropwise at 3°–6° C. over six hours to the five-liter flask containing the aniline and hydrochloric acid. The five-liter flask is cooled to maintain the temperature of the contents of between 3°–6° C., and the mixture is stirred overnight. The contents of the five-liter flask are filtered and the filtrate is slurried with two liters of distilled water for one day, refiltered, and slurried with two liters of methanol for one day. The polyaniline acid salt is recovered by filtration, dried in a vacuum oven, screened, and thereafter dried in a vacuum oven at 150° C. The aniline salt obtained in this manner contains 12.15% nitrogen, 5.1% sulfur and 3.07% chlorine.

The above prepared polyaniline salt (138.5 parts) is added to 2000 ml. of distilled water in a five-liter flask. Aqueous ammonium hydroxide (132 ml., 2 moles) is added with stirring and the stirring is continued for one day. The product is filtered, and the residue is slurried with two liters of water for one day, filtered and dried in a steam oven. After screening, the product is dried in a vacuum oven at 150° C. The product obtained in this manner contains 14.2% nitrogen (theory, 15.38), 0.14% sulfur and 0.67% chlorine.

EXAMPLE 3

The general procedure of Example 1 is repeated with the exception that 427.5 parts (1.875 moles) of ammonium persulfate is utilized. The polyaniline acid salt obtained in this manner contains 11.6% nitrogen, 5.38% sulfur and 2.69% chlorine when the salt is treated with ammonium hydroxide as in Example 1, the product contains 14.8% nitrogen (theory, 15.38), 0.47% chlorine and 0.06% sulfur.

EXAMPLE 4

A polyaniline salt is prepared in accordance with the general procedure of Example 1 and the salt contains 11.33% nitrogen, 2.91% chlorine and 4.79% sulfur. The polyaniline salt (100 parts) is stirred at room temperature with 66 ml. (1 mole) of concentrated ammonium hydroxide diluted to two liters with distilled water in a three-liter flask for one day. The black solid which is produced is recovered by filtration, slurried with one liter of distilled water and recovered by filtration. The filtrate is dried in a steam oven, powdered and dried again in a vacuum oven at 100°–110° C. The product obtained in this manner contains 14.2% nitrogen and 0.32% chlorine but no detectable sulfur.

EXAMPLE 5

Hydrochloric acid (415 parts, 5 moles) is added to 3600 ml. distilled water, and 465 parts (5 moles) of aniline are added dropwise with stirring. A solution of 1140 parts (5 moles) of ammonium persulfate in 3500 parts of water is added dropwise over 7.5 hours at a temperature of 5°–12° C. After stirring overnight, the product is filtered, and the residue is stirred with water overnight. The solid is recovered by filtration and slurried with methanol overnight. The product is recovered by filtration, dried in a steam chest, and washed with 5000 parts of water. After drying in a vacuum oven at 150° C. for 20 hours, the product contains 14.9% nitrogen and 0.74% chlorine but no detectable sulfur.

Into a 12-liter flask there is added 300 parts of the above-prepared polyaniline salt, 6000 parts of distilled water and 198 ml. (3 moles) of concentrated ammonium hydroxide. The mixture is stirred at room temperature for two weeks, and the pH of the mixture at this time is greater than 10. The solid product is recovered by filtration, and the residue is slurried in distilled water with stirring for one day. This mixture is filtered and the residue is dried in a steam oven, passed through a 710 micron screen and dried in a vacuum oven at 150° C. The product obtained in this manner contains 15.15% nitrogen. No sulfur or chlorine can be detected.

EXAMPLE 6

Hydrochloric acid (73 parts, 2 moles) and 2000 parts of distilled water are added to a five-liter flask followed by 186 parts (2 moles) of aniline. A solution of 448 parts (2 moles) of ammonium persulfate in 1500 parts of water is added over 40 minutes as the reaction exotherms from 32° to 51° C. The reaction mixture is allowed to stand overnight. The solid is recovered by filtration, and is washed with two liters of distilled water followed by a final wash with methanol. The dark green polyaniline salt is dried.

The above prepared polyaniline salt (31.9 parts, 0.25 mole) is slurried in 250 parts of methanol in a one-liter flask. Aqueous potassium hydroxide prepared by dissolving 28 parts (0.5 mole) of potassium hydroxide in 250 parts of water is added in increments to the one-liter flask and stirred for one day at room temperature. The solid product is recovered by filtration, washed with aqueous methanol and finally with methanol. The product obtained in this manner is dried in a vacuum oven at 65° C., and an analysis indicates a chlorine content of 0.39%.

EXAMPLE 7

In a three-liter flask, there are charged 719 parts (1 mole) of the sulfo acid polymer salt of Example C which then is diluted to one liter with distilled water, and 93 parts (1 mole) of aniline are added dropwise at room temperature to form a yellow solution. In a separate vessel, 228 parts (1 mole) of ammonium persulfate are dissolved in 750 parts of water, and the solution is added dropwise over 8 hours to the three-liter flask. The contents of the reaction flask are then filtered, and the solid residue obtained in this manner is slurried with 1500 parts of water for one day, filtered, slurried with 1500 parts of methanol and allowed to stand several days. The precipitate is recovered by filtration, dried in a steam oven for several days, screened and dried in a vacuum oven at 150° C. The polyaniline salt obtained in this manner contains 10.85% nitrogen and 6.60% sulfur.

Aqueous ammonium hydroxide (11 ml., 0.167 mole) is added to one liter of distilled water in a two-liter flask. The above prepared polyaniline salt (80.8 parts, 0.167 mole) is added to the two-liter flask and the mixture is stirred at room temperature for one day. Following filtration, the solid product is water-washed, dried in a steam oven, screened and finally dried in a vacuum oven at 150° C. The product obtained in this matter contains 12.18% nitrogen and 4.54% sulfur.

EXAMPLE 8

Into a five-liter flask there are charged 167.4 parts (1.8 moles) of aniline, 36.85 parts (0.2 mole) of N-phenyl-p-phenylenediamine, 166 ml. (2 moles) of aqueous concentrated hydrochloric acid and 1200 ml. of water. The mixture is cooled to 4° C., and a solution of 456 parts (2 moles) of ammonium persulfate in 1400 ml. of water is added at 4°–8° C. over 7 hours with stirring. The mixture is stirred overnight and filtered. The solid product obtained in this manner is slurried in three liters of distilled water and stirred overnight. After filtering, the product is slurried in three liters of methanol overnight. The product is recovered by filtration and slurried in 2.5 liters of distilled water with 132 ml. (2 moles) of aqueous concentrated ammonium hydroxide with stirring for 48 hours. The product is then filtered, slurried in aqueous ammonium hydroxide for an additional 48 hours, and finally slurried in 2.5 liters of distilled water overnight. The product is recovered by filtration, dried in a steam oven, ground, and dried in a vacuum oven at 150° C. The product contains 14.76% nitrogen. No sulfur is detected.

EXAMPLE 9

A five-liter flask is charged with 169.2 parts (1.8 moles) of aniline, 13.6 parts (0.2 mole) of pyrrole and 2000 parts of water. The flask is equipped with a mechanical stirrer, a thermowell, a thermometer and a dropping funnel. The reaction mixture is cooled to 14° C. by external cooling. A solution of 486 parts (2 moles) of sodium persulfate in 1000 parts of water is added dropwise to the reaction flask over a period of about six hours while maintaining the temperature at between 15 and 20° C. Stirring is continued overnight and the black reaction mixture is filtered. The solid product obtained in this manner is washed with 1000 parts of water and is thereafter slurried with 2500 parts of water with stirring. After recovering the black residue by filtration, it is slurried with 132 parts (2 moles) of ammonium hydroxide and 2000 parts of water (pH=10.6). Stirring is continued overnight whereupon the pH of the mixture is 9.2. The mixture is filtered, and the residue is slurried with 2500 parts of water for about 20 hours and again with 2500 parts of water for about 5 hours. The solid product obtained upon filtration is dried in a forced air oven at about 100° C. for several days and in a vacuum oven at 140° C. for 24 hours. The black solid obtained in this manner contains 13.9% nitrogen and 1.82% sulfur.

EXAMPLE 10

Into a three-liter reaction flask there are added 93 grams of CF-11 Cellulose (Whatman) and one liter of distilled water followed by a 83 parts (1 mole) of aqueous hydrochloric acid and 93 parts (1 mole) of aniline dropwise. A solution of 228 parts (1 mole) of ammonium persulfate in 600 ml. distilled water is added dropwise at a temperature of less than z10° C. The mixture is allowed to stand two days, filtered, and the residue is slurried with 1000 parts of water for one day. The mixture is filtered and the residue is slurried with 1000 parts of methanol for one day. After the slurry is filtered, the residue is dried in a steam oven overnight. Ammonium hydroxide (66 parts, 1 mole) diluted to 2000 parts with distilled water is added to a three-liter flask, and the polyaniline acid salt prepared above is added. The mixture is stirred for one day and allowed to stand for two days. The mixture is filtered and the residue is slurried in distilled water for one day and again filtered. The residue is dried overnight in a steam oven and thereafter dried in a vacuum oven at 150° C. The product contains 6.03% nitrogen, 0.15% chlorine. No sulfur is detected.

EXAMPLE 11

A five-liter flask is charged with 139.5 parts of CF-1 Cellulose (Whatman) in 1500 parts of water. Aqueous hydrochloric acid (124.5 ml., 1.5 moles) is added followed by the addition dropwise of 139.5 parts (1.5 moles) of aniline with stirring. The slurry is cooled to 5° C. in an ice bath, and a solution of 342 parts (1.5 moles) of ammonium persulfate in 1400 ml. of water is added dropwise at 4°-7° C. After stirring overnight, the mixture is filtered, and the residue is slurried in two liters of distilled water for one day. After filtering, the residue is slurried in two liters of methanol for one day and allowed to stand for two days. The mixture is then filtered and residual methanol is evaporated. The solid residue is slurried in 2500 parts of water in 99 parts (1.5 moles) of ammonium hydroxide are added slowly and the mixture is stirred for one day. After filtering, the residue is slurried in 2000 parts of distilled water, stirred for one day and filtered. The residue is dried in a steam oven for two days, screened, and dried in a vacuum oven at 150° C. The product obtained in this manner contains 6.82% nitrogen and 0.23% chlorine. No sulfur is detected.

EXAMPLE 12

A solution of 108.9 parts (0.45 mole) of cupric nitrate trihydrate in one liter of distilled water is prepared. To this solution, zeolite LZ-Y52 (127.5 parts) is added and the mixture is stirred and allowed to exchange for 10 days. The mixture is then filtered and the residue is dried in a vacuum oven at 200° C. The powder is light blue color. This copper containing zeolite (50 parts) is placed in a dessicator with a shallow dish of aniline, and a gas phase polymerization occurs over a period of 20 days with frequent stirring. The powder obtained in this manner is dried in a vacuum oven at 150° C., and the powder contains 2.89% nitrogen (theory, 2.9).

EXAMPLE 13

A blend of polyaniline hydrochloric acid salts (100 parts) prepared in accordance with the general procedure of Example 1 and treated with ammonium hydroxide (less than about 0.03% CI) is slurried with one liter of distilled water, and 0,468 ml. of concentrated hydrochloric acid (0.0056 mole) diluted in water is added dropwise to the aniline salt slurry with stirring. The mixture is stirred at room temperature for several days and then filtered. The residue is washed with water, dried in a steam oven, sieved through a 0.71 mm. sieve, and dried in a vacuum oven at 150° C. The product obtained in this manner contains 14.2% nitrogen and 0.25% chlorine.

EXAMPLE 14

The general procedure of Example 13 is repeated except that 0.936 ml. (0.0113 mole) of concentrated hydrochloric acid is utilized. The product obtained in this manner contains 14.6% nitrogen and 0.47% chlorine.

EXAMPLE 15

The general procedure of Example 13 is repeated except that 1.404 ml. (0.017 mole) of concentrated hydrochloric acid is utilized. The product obtained in this manner contains 14.5% nitrogen and 0.56% chlorine.

EXAMPLE 16

Phosphoric acid (85%, 0.68 part, 0.01 mole) is added to 500 ml. of distilled water in a one-liter flask. A blend of ammonium hydroxide treated polyaniline acid chloride salts prepared as in Example 1 (45 parts, 0.5 mole) is added and the mixture is stirred at room temperature for one day. The mixture is filtered, and the residue is washed with water and dried in a steam oven. After screening, the powder is dried in a vacuum oven at 150° C. The product obtained in this manner contains 13.58% nitrogen and 0.6% phosphorus.

EXAMPLE 17

Water (500 parts) and 46.4 parts (0.2 mole) of the polyaniline salt prepared in Example 10 are added to a one-liter flask, and a solution of 0.25 parts of concentrated hydrochloric acid in 10 parts of water is added dropwise. The mixture is stirred for one day and filtered. The residue is slurried with 1000 parts of distilled water and allowed to stand for two days. The slurry is filtered, and the residue is dried in a steam oven, screened, and dried in a vacuum oven at 150° C. The product obtained in this manner contains 6.08% nitrogen and 0.31% chlorine.

EXAMPLE 18

The general procedure of Example 17 is repeated except that 0.33 part (0.004 mole) of concentrated hydrochloric acid is used. The product obtained in this manner contains 6.2% nitrogen and 0.33% chlorine.

EXAMPLE 19

The general procedure of Example 17 is repeated except that 0.5 part (0.006 mole) of concentrated hydrochloric acid is used. The product obtained in this manner contains 6.18% nitrogen and 0.55% chlorine.

EXAMPLE 20

A blend of ammonium hydroxide treated polyaniline hydrochloric acid salts prepared as in Example 1 (40 parts) is charged to a dish in a dessicator containing an excess of iodine crystals. The contents of the dessicator are allowed to equilibrate with occasional mixing over a period of 33 days. A weight increase of 2.18 parts is observed indicating an iodine content of 6.17%.

EXAMPLE 21

The general procedure of Example 20 is repeated with 25 parts of the polyaniline blend and an excess of iodine crystals for five days. A weight increase of 2.8% is obtained.

EXAMPLE 22

Water (400 parts ) and 48.25 parts (0.5 mole) of the blend ammonium hydroxide treated polyaniline acid salt of Example 16 are added to a one liter flask, and 71.9 parts (0.1 mole) of the sodium salt of the sulfo acid polymer of Example C are added dropwise at room temperature. The mixture is stirred for one day and allowed to stand for two days. The mixture is filtered, and the residue is washed with water, dried in a steam oven for two days, screened, and dried in a vacuum oven at 150° C. The product obtained in this manner contains 13.91% nitrogen and 1.56% sulfur.

EXAMPLE 23

A three-liter reaction flask is charged with 280 parts (3.37 moles) of aqueous hydrochloric acid, and 197.9 parts (2.12 moles) of aniline is added with stirring. Vanadium trichloride (0.4 part) is added as an aqueous solution, and the contents of the reaction vessel are cooled to 4° C. Sodium chlorate (246.3 parts, 2.31 moles) is added as an aqueous solution dropwise over several hours at 4° C. Stirring is continued overnight. The reaction mixture is filtered and the residue is slurried with two liters of water for one day and filtered. The solid residue thus obtained is slurried in absolute methanol for one day at room temperature and filtered. The residue is slurried in aqueous ammonium hydroxide for two days, filtered, and this residue is slurried in two liters of water for two days. The product is recovered by filtration and dried in a steam oven for one day, ball-milled, dried in a vacuum oven at 150° C. for one day and at 50° C. for four hours. The product obtained in this manner contains 13.75% nitrogen and 4.37% chlorine.

EXAMPLE 24

A polyaniline (100 parts) prepared by the general procedure of Example 1 is slurried in one liter of distilled water in a two-liter flask, and 1.03 parts of concentrated sulfuric acid in 25 parts of distilled water are added dropwise with stirring. The mixture is stirred overnight, filtered, dried in a steam oven and then in a vacuum oven at 140° C.

EXAMPLE 25

A two-liter flask is charged with one liter of distilled water and 1.9 parts of p-toluene sulfonic acid monohydrate. To this mixture there are added 100 parts of a polyaniline prepared as in Example 1. The mixture is stirred at room temperature for several hours and filtered. The solid product obtained in this manner is dried in a steam oven and then in a vacuum oven at 1.40° C.

The ER fluids of the present invention are prepared by mixing the above-described polyaniline compounds (as the dispersed phase) with the selected hydrophobic liquid phase. The polyaniline products may be comminuted to certain particle sizes if desired. The electrorheological fluids of the present invention may contain from 5 to about 80% by weight of the dispersed phase. More often the ER fluids may contain a minor amount (i.e., up to about 49%) of the dispersed phase. In one embodiment, the ER fluids of the present invention will contain from about 5 to about 40% by weight of the polyaniline dispersed phase, and in another embodiment, the ER fluids will contain from about 20 to about 40% of the polyaniline compounds.

In accordance with certain embodiments of the present invention, electrorheological fluids are provided which are characterized as having a Winslow Number (Wn) in excess of 3000 at 20° C., and in other embodiments, the ER fluids are characterized as having Wn in excess of 100 at the maximum temperature of the intended application. This temperature may be 80° C., 100° C., or even 120° C.

Desirable and useful ER fluids are provided in accordance with the present invention which are essentially non-aqueous or essentially anhydrous. Small amounts (for example, less than about 1% based on the total weight of the fluid) of water may be present which may, in fact, be essentially impossible to remove, but such amounts do not hinder the performance of the ER fluids of the present invention.

In addition to the hydrophobic liquid phase and the dispersed particulate phase of polyaniline, the ER fluids of the present invention may contain other components capable of imparting or improving desirable properties of the ER fluid. Examples of additional components which may be included in the ER fluids of the present invention include organic polar compounds, organic surfactants or dispersing agents, viscosity index improvers, etc. The amount of the above additional components included in the ER fluids of the present invention will be an amount sufficient to provide the fluids with the desired property and/or improvement. Generally, from about 0 to about 10% by weight, and more often from about 0 to about 5% by weight of one or more of the additional components can be included in the ER fluids of the present invention to provide desirable properties including viscosity and temperature stability. It is highly desirable, for example, that the particulate dispersed phase remain dispersed over extended periods of time such as during storage, or, if the particulate dispersed phase settles on storage, the phase can be readily redispersed in the hydrophobic liquid phase.

In one embodiment, it is desirable to include in the ER fluids of the present invention at least one organic polar compound. Examples of useful polar compounds include organic compounds such as amines, amides, nitriles, alcohols, polyhydroxy compounds, ketones and esters. Examples of amides include acetamide and N-methyl acetamide. Polyhydroxy compounds are useful in the ER fluids of the present invention, and examples of such polar compounds include ethylene glycol, diethylene glycol, propylene glycol, glycerol, pentaerythritol, etc.

The surfactants which can be utilized in the ER fluids of the present invention are useful for improving the dispersion of the solids throughout the vehicle and in maintaining the stability of the dispersions. Preferably, the surfactants are soluble in the hydrophobic liquid phase. The surfactants may be of the anionic, cationic or nonionic type although the nonionic type of surfactants generally are preferred. Examples of nonionic surfactants useful in the ER fluids of the present invention include fatty acids, partial or complete esters of polyhydric alcohols including fatty acid esters of ethylene glycol, glycerine, mannitol and sorbitol. Specific examples include sorbitan sesquioleate sorbitan monooleate, sorbitan monolaurate, glycerol monooleate, glycerol dioleate, mixtures of glycerol mono- and dioleate, polyoxyalkylene derivatives of sorbitan trioleate, etc.

In one embodiment, the surfactants are functionalized polysiloxanes including amino functional, hydroxy functional, mercapto functional, carboxy functional, acetoxy functional or alkoxy functional polysiloxanes which generally have a molecular weight above 800. The functional groups may be terminal, internal, or terminal and internal. The functional polysiloxane surfactants may be represented by the following formula (II)

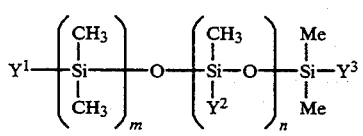

wherein each of $Y^1$–$Y^3$ is independently $CH_3$ or a functional group selected from —R'N(R')H, —R'OH, —R'OR, —R'SH, —R'COOH wherein R' is a divalent group consisting of C, H and optionally O and/or N, R is hydrogen or an alkyl group containing 1 to about 8 carbon atoms, or $—(CH_2CH_2O)_p—R^2$, or $—(CH_2CH(CH_3)—O)_pR^{hu\ 2}$, $R^2$, $R^2$ is H or a hydrocarbyl group, m is a number from about 10 to about 1000, n is a number from 0 to 10, and p is a number from 1 to about 50, provided that at least one of $Y^1$–$Y^3$ is not $CH_3$. In one embodiment, both $Y^1$ and $Y^3$ are functional groups and $Y^2$ is methyl. These silicones are referred to herein as terminally functionalized silicones. When $Y^1$ and $Y^3$ are methyl, and $Y^2$ is one of the functional groups reacted, the silicone is referred to as an internally functionalized silicone.

The divalent group R' may be an alkylene group, an oxy alkylene group or an amino alkylene group wherein the oxygen atom or the nitrogen atom, respectively, are attached to the silicon atom. The alkylene group may contain from 1 to about 3 or 4 carbon atoms, and specific examples include methylene, ethylene, n-propylene, i-propylene, etc. Hydrocarbyl groups $R^2$ may be aryl or alkyl groups. Generally $R^2$ is a lower alkyl such as methyl, ethyl, etc.

Specific examples of the functional groups $Y^1$–$Y^3$ which may be included in the siloxanes of Formula (II) include $—CH_2NH_2$, $—CH_2N(CH_3)H$, $—CH_2CH_2NH_2$, $—CH_2CH_2CH_2NH_2$, $—CH_2CH_2SH$, $—CH_2CH_2CH_2OH$, $—CH_2CH_2CH_2—SH$, $—CH_2CH_2COOH$, $—CH_2CH_2CH_2COOH$, $CH_2CH_2OCH_3$, $OCH_2CH_2OH$, $OCH_2CH_2NH_2$, $—CH_2O(CH_2CH_2O)_2H$, $—CH_2O(CH_2CH_2O)_2H$, $—CH_2O(CH_2CH_2O)_2CH_3$, $—CH_2O(CH_2CH—CH_3)O)_pH$, $—CH_2O(CH_2CH(CH_3)O_pCH_3$, etc.

Functionalized polysiloxanes which are useful as surfactants in the ER fluids of the present invention are available commercially from a variety of sources. For example, an internal carbinol functional silicone polymer is available from Genesee Polymers Corporation, Flint, Mich., under the trade designation EXP-69 Silicone Fluid. This fluid is reported to be characterized by (IIA)

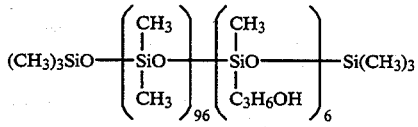

A mercapto modified silicone also is available from Genesee Polymers under the designation GP-72A. The following is given as a representative structure by the manufacturer.

(IIB)

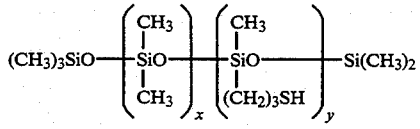

An example of a commercially available carboxy-terminated polysiloxane is PS573 from Petrarch Systems, Bristol, Pa. which may be characterized by Formula (IIC).

(IIC)

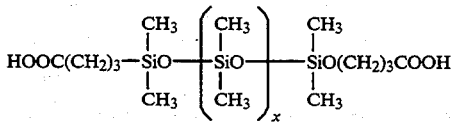

In some instances, it may be desirable to add materials capable of increasing and stabilizing the viscosity of the ER fluids when the fluid is not under the influence of an electrical field. Materials which have been described in the literature as viscosity modifying agents in lubricating oils may be used for this purpose in the fluids of the present invention. Viscosity modifying agents generally are polymeric materials characterized as being hydrocarbon-based polymers generally having a number average molecular weight of between about 25,000 and 500,000, more often between about 50,000 and 200,000. The viscosity modifiers may be included in the ER fluids of the present invention in amounts from about 0 to about 10% or more as required to modify the viscosity of the fluid as desired.

Polyisobutylenes, polymethacrylates (PMA), ethylene-propylene copolymers (OCP), esters of copolymers of styrene and maleic anhydride, hydrogenated polyalpha-olefins and hydrogenated styrene-conjugated diene copolymers are useful classes of commercially available viscosity modifiers.

Polymethacrylates (PMA) are prepared from mixtures of methacrylate monomers having different alkyl groups. Most PMA's are viscosity modifiers as well as pour point depressants. The alkyl groups may be either straight chain or branched chain groups containing from 1 to about 18 carbon atoms.

The ethylene-propylene copolymers, generally referred to as OCP can be prepared by copolymerizing ethylene and propylene, generally in a solvent, using known catalysts such as a Ziegler-Natta initiator. The ratio of ethylene to propylene in the polymer influences the oil-solubility, oil-thickening ability, low temperature viscosity and pour point depressant capability of the product. The common range of ethylene content is 45–60% by weight and typically is from 50% to about 55% by weight. Some commercial OCP's are terpolymers of ethylene, propylene and a small amount of non-conjugated diene such as 1,4-hexadiene. In the rubber industry, such terpolymers are referred to as EPDM (ethylene propylene diene monomer).

Esters obtained by copolymerizing styrene and maleic anhydride in the presence of a free radical initiator and thereafter esterifying the copolymer with a mixture of $C_{4-18}$ alcohols also are useful as viscosity-modifying additives.

The hydrogenated styrene-conjugated diene copolymers are prepared from styrenes such as styrene, alpha-methyl styrene, ortho-methyl styrene, meta-methyl styrene, para-methyl styrene, para-tertiary butyl styrene, etc. Preferably the conjugated diene contains from 4 to 6 carbon atoms. Examples of conjugated dienes include piperylene, 2,3-dimethyl-1,3-butadiene, chloroprene, isoprene and 1,3-butadiene, with isoprene and butadiene being particularly preferred. Mixtures of such conjugated dienes are useful.

The styrene content of these copolymers is in the range of about 20% to about 70% by weight, preferably about 40% to about 60% by weight. The aliphatic conjugated diene content of these copolymers is in the range of about 30% to about 80% by weight, preferably about 40% to about 60% by weight.

These copolymers can be prepared by methods well known in the art. Such copolymers usually are prepared by anionic polymerization using, for example, an alkali metal hydrocarbon (e.g., sec-butyllithium) as a polymerization catalyst. Other polymerization techniques such as emulsion polymerization can be used.

These copolymers are hydrogenated in solution so as to remove a substantial portion of their olefinic double bonds. Techniques for accomplishing this hydrogenation are well known to those of skill in the art and need not be described in detail at this point. Briefly, hydrogenation is accomplished by contacting the copolymers with hydrogen at super-atmospheric pressures in the presence of a metal catalyst such as colloidal nickel, palladium supported on charcoal, etc.

In general, it is preferred that these copolymers, for reasons of oxidative stability, contain no more than about 5% and preferably no more than about 0.5% residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation, as determined by the afore-mentioned analytical techniques.

These copolymers typically have number average molecular weights in the range of about 30,000 to about 500,000, preferably about 50,000 to about 200,000. The weight average molecular weight for these copolymers is generally in the range of about 50,000 to about 500,000, preferably about 50,000 to about 300,000.

The above-described hydrogenated copolymers have been described in the prior art. For example, U.S. Pat. No. 3,554,911 describes a hydrogenated random butadiene-styrene copolymer, its preparation and hydrogenation. The disclosure of this patent is incorporated herein by reference. Hydrogenated styrene-butadiene copolymers useful as viscosity-modifiers in the ER fluids of the present invention are available commercially from, for example, BASF under the general trade designation "Glissoviscal". A particular example is a hydrogenated styrene butadiene copolymer available under the designation Glissoviscal 5260 which has a number average molecular weight of about 120,000. Hydrogenated styrene-isoprene copolymers useful as viscosity modifiers are available from, for example, The Shell Chemical Company under the general trade designation "Shellvis". Shellvis 40 from Shell Chemical Company is identified as a diblock copolymer of styrene and isoprene having a number average molecular weight of about 155,000, a styrene content of about 19 mole percent and an isoprene content of about 81 mole percent. Shellvis 50 is available from Shell Chemical Company and is identified as a diblock copolymer of styrene and isoprene having a number average molecular weight of about 100,000, a styrene content of about 28 mole percent and an isoprene content of about 72 mole percent.

The following examples illustrate some of the fluids of the present invention. Silicone oil (10 cst) is a polydimethyl silicone oil from Dow Corning.

| | %/Wt. |
|---|---|
| ER Fluid A | |
| Polyaniline salt of Ex. 9 | 15.0 |
| Glycerol monooleate | 3.0 |
| Trisun 80 | 82.0 |
| ER Fluid B | |
| Polyaniline salt of Ex. 5 | 20.0 |
| Glycerol monooleate | 3.0 |
| Emery 2960 | 77.0 |
| ER Fluid c | |
| Iodine treated polyaniline salt of Ex. 21 | 15.0 |
| EXP-69 silicone | 3.0 |
| Silicone oil (10 cst) | 82.0 |
| ER Fluid D | |
| Polyaniline salt of Ex. 1 | 15.0 |
| Oleic acid | 3.0 |
| Trisun 80 | 82.0 |
| ER Fluid E | |
| Polyaniline salt of Ex. 1 | 15.0 |

-continued

| | %/Wt. |
|---|---|
| Silicone oil (10 cst) | 85.0 |
| ER Fluid F | |
| Polyaniline salt of Ex. 2 | 20.0 |
| Glycerol monooleate | 3.0 |
| Emery 3004 | 77.0 |
| ER Fluid G | |
| Polyaniline salt of Ex. 1 | 15.0 |
| PS563 (carboxy terminated silicone) | 3.0 |
| Silicone oil (10 cst) | 82.0 |
| ER Fluid H | |
| Polyaniline salt of Ex. 1 | 25.0 |
| EXP 69 silicone | 5.0 |
| Silicone oil (10 cst) | 70.0 |
| ER Fluid I | |
| Polyaniline salt of Ex. 7 | 15.0 |
| EXP 69 silicone | 3.0 |
| Silicone oil (10 cst) | 82.0 |
| ER Fluid J | |
| Hydrochloric acid treated polyaniline salt of Ex. 13 | 15.0 |
| EXP 69 silicone | 3.0 |
| Silicone oil (10 cst) | 82.0 |
| ER Fluid K | |
| Phosphoric acid treated polyaniline salt of Ex. 16 | 15.0 |
| EXP 69 silicone | 3.0 |
| Silicone oil (10 cst) | 82.0 |
| ER Fluid L | |
| Hydrochloric acid treated polyaniline salt of Ex. 17 | 15.0 |
| EXP 69 silicone | 2.0 |
| Silicone oil (10 cst) | 83.0 |
| ER Fluid M | |
| Iodine treated polyaniline salt of Ex. 20 | 15.0 |
| EXP 69 silicone | 3.0 |
| Silicone oil (10 cst) | 82.0 |
| ER Fluid N | |
| Polyaniline salt of Ex. 7 | 15.0 |
| EXP 69 silicone | 3.0 |
| Silicone oil (10 cst) | 82.0 |
| ER Fluid O | |
| Polyaniline salt of Ex. 2 | 15.0 |
| Ethylene glycol | 3.0 |
| Silicone oil (10 cst) | 82.0 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

EXAMPLE 26

Four hundred fifteen grams of concentrated hydrochloric acid is diluted with 3 L distilled water in a 12 L round bottom flask. Aniline, 465 g, is added dropwise. The mixture is cooled to 5° C. in an ice bath. A solution of ammonium persulfate, 1140 g in 3.5 L of distilled water, is added dropwise over 8 hours. The reaction mixture is left stirring overnight.

The reaction mixture is filtered and the solids are collected. The solids are returned to the flask along with 6 L of water, and are stirred for 24 hours.

The mixture is again filtered and the solids are collected and placed in the flask along with 330 mL concentrated ammonium hydroxide and 6 L distilled water. The mixture is stirred for 24 hours.

The mixture is filtered and the recovered solid is again placed into a flask with 330 mL concentrated ammonium hydroxide and 6 L water. The mixture is stirred for 48 hours.

The mixture is filtered and the recovered solids are stirred with 6 L distilled water for 24 hours. The mixture is thereafter filtered and the solid flushed with 4 L of distilled water.

The recovered solid is predried while still in the filter funnel for 18 hours at 20° C. Thereafter the solid is sieved through a 710 μm screen, dried at 150° C. under vacuum for 17 hours, and then placed in a glass jar.

Thereafter the solid polymer is formulated into an electrorheological fluid.

EXAMPLE 27

Two hundred eight grams of cellulose (CC31 microgranular cellulose powder from Whatman) is combined with 26 mL concentrated hydrochloric acid, 26 g aniline, and 5835 g distilled water in a 12 L round-bottom flask equipped with a mechanical stirrer and an addition funnel. Ammonium persulfate, 65 g, is dissolved in 165 g distilled water, and the solution is added to the flask dropwise, with stirring, at a rate of 2 mL per minute at room temperature. After the addition is complete, the reaction mixture is stirred overnight. The reaction mixture is filtered; the filter cake is allowed to stand for several (about 70) hours. Thereafter the solids are stirred for 20 hours with 9.8 mL concentrated ammonium hydroxide dissolved in 6 L of water. The solids are isolated by filtration and washed by stirring with an additional 6 L of water for several hours. The washed solids are isolated by filtration and dried at 110° C. in a steam oven, sieved through a 710 μm screen, and finally dried for 17 hours in a vacuum oven at 150° C.

Thereafter the solids are formulated into an electrorheological fluid.

What is claimed is:

1. A non-aqueous electrotheological fluid which comprises a hydrophobia; liquid phase and at least about 15 percent, by weight of the composition of a dispersed particulate phase of a polyaniline prepared by polymerizing aniline, using about 1 to about 2 moles of an oxidizing agent per mole of aniline to effect polymerization thereof, wherein the oxidant is added to the aniline, and from about 0.1 to about 1.2 moles of an acid per mole of aniline to form an acid salt of polyaniline, and thereafter treating the acid salt with a base in an mount and for a period of time sufficient to remove at least a portion of the acidic protons therefrom.

2. The electrorheological fluid of claim 1 wherein the acid is a mineral acid.

3. The electrorheological fluid of claim 2 wherein the mineral acid is hydrochloric acid.

4. The electrorheological fluid of claim 1 wherein the acid is an organic acid.

5. The electrorheological fluid of claim 4 wherein the organic acid is a sulfonic, sulfinic, carboxylic or phosphorus acid.

6. The electrorheological fluid of claim 4 wherein the organic acid is an alkyl sulfonic acid, an aryl sulfonic acid, an alkyl carboxylic acid, or an aryl carboxylic acid.

7. The electrorheological fluid of claim 4 wherein the organic acid is (a) a sulfo acid monomer represented by the formula $$(R_1)_2C{=}C(R_1)Q_aZ_b \qquad (I)$$

wherein each $R_1$ is independently hydrogen or a hydrocarbyl group; a is 0 or 1; b is 1 or 2, provided that when a is 0, then b is 1;

Q is a divalent or trivalent hydrocarbyl group or $C(X)NR_2Q'$;

each $R_2$ is independently hydrogen or a hydrocarbyl group;

Q' is a divalent or trivalent hydrocarbyl group;

X is oxygen or sulfur; and

Z is S(O)OH, or $S(O)_2OH$; or (b) a polymer of at least one of said monomers.

8. The electrorheological fluid of claim 7 wherein the organic acid is (b) a polymer of at least one of said sulfo acid monomer.

9. The electrorheological fluid of claim 8 wherein: a and b are 1; Q is $C(X)NR_2Q'$; X is oxygen; Q' is an alkylene group having 1 to about 18 carbon atoms; and Z is $S(O)_2OH$.

10. The electrorheological fluid of claim 7 wherein the polymer (b) is an interpolymer of the sulfo monomer (a) and at least one comonomer selected from the group consisting of acrylic compounds; maleic acids, anhydrides or salts; vinyl lactams; vinyl pyrrolidones; and fumaric acids or salts.

11. The electrorheological fluid of claim 1 wherein the oxidizing agent is a metal or ammonium persulfate.

12. The electrorheological fluid of claim 1 wherein the oxidizing agent is ammonium persulfate.

13. The electrorheological fluid of claim 1 wherein the acid salt is treated with ammonium hydroxide, an alkali or alkaline earth metal oxide, an alkali or alkaline earth metal hydroxide, an alkali or alkaline earth metal alkoxide, or an alkali or alkaline earth metal carbonate.

14. The electrorheological fluid of claim 1 wherein the polyaniline acid salt is treated with an amount of the base for a period of time sufficient to remove substantially all of the protons derived from the acid.

15. The electrorheological fluid of claim 14 wherein the polyaniline which is substantially free of acidic protons is treated with an amount of an acid, a halogen, sulfur, sulfur halide, $SO_3$, or a hydrocarbyl halide to form a polyaniline compound having a desired conductivity.

16. The electrorheological fluid of claim 15 wherein the acid is a mineral acid, Lewis acid or an organic acid, or mixtures thereof.

17. The electrorheological fluid of claim 15 wherein the acid is an organic monosulfonic acid, an organic polysulfonic acid, an organic monosulfinic acid, an organic polysulfinic acid, an organic monocarboxylic acid, an organic polycarboxylic acid, an organic monophosphorus acid, an organic polyphosphorus acid, or mixtures thereof.

18. The electrorheological fluid of claim 17 wherein the organic acid is an alkyl or aryl monosulfonic acid, an alkyl or aryl polysulfonic acid, an alkyl or aryl monocarboxylic acid, an alkyl or aryl polycarboxylic acid, or mixtures thereof.

19. The electrorheological fluid of claim 15 wherein the polyaniline which is substantially free of acidic protons is treated with (a) a sulfo acid monomer represented by the formula $$(R_1)_2C{=}C(R_1)Q_aZ_b \quad (I)$$

wherein each $R_1$ is independently hydrogen or a hydrocarbyl group; a is 0 or 1; b is 1 or 2, provided that when a is 0, then b is 1;

Q is a divalent or trivalent hydrocarbyl group or $C(X)NR_2Q'$;

each $R_2$ is independently hydrogen or a hydrocarbyl group;

Q' is a divalent or trivalent hydrocarbyl group;

X is oxygen or sulfur; and

Z is S(O)OH, or $S(O)_2OH$; or (b) a polymer of at least one of said monomers.

20. The electrorheological fluid of claim 19 wherein the organic acid is (b) a polymer of at least one of said sulfo acid monomer.

21. The electrorheological fluid of claim 20 wherein: a and b are 1; Q is $C(X)NR_2Q'$; X is oxygen; Q' is an alkylene group having 1 to about 18 carbon atoms; and Z is $S(O)_2OH$.

22. The electrorheological fluid of claim 15 wherein the polyaniline which is substantially free of acidic protons is treated with iodine.

23. The electrorheological fluid of claim 15 wherein the polyaniline which is substantially free of acid protons is treated with a mineral acid.

24. The electrorheological fluid of claim 23 wherein the mineral acid is hydrochloric acid.

25. The electrorheological fluid of claim 15 wherein the polyamine which is substantially free of acidic protons is treated with a Lewis acid.

26. The electrorheological fluid of claim 24 wherein polyaniline is treated with an amount of hydrochloric acid sufficient to provide a salt containing from 0.01 to about 1% chlorine.

27. The electrorheological fluid of claim 1 wherein the polyaniline is prepared by polymerizing aniline in the presence of approximately equimolar amounts of the acid and the oxidizing agent.

28. The electrorheological fluid of claim 1 wherein the polyaniline is prepared by adding an aqueous solution of the oxidizing agent to an aqueous mixture of aniline and acid while maintaining the temperature of the reaction below about 50° C.

29. The electrorheological fluid of claim 28 wherein the temperature of the reaction is maintained below about 10° C.

30. The electrorheological fluid of claim 28 wherein the acid is a mineral acid and the oxidizing agent is a metal or ammonium persulfate.

31. The electrorheological fluid of claim 1 wherein the polyaniline is prepared from a mixture of aniline and up to about 50% by weight of another monomer selected from pyrroles, vinylpyridines, vinylpyrrolidones, thiophenes, vinylidene halides, phenothiazines, imidazolines, N-phenyl-p-phenylene diamines or mixtures thereof.

32. The electrorheological fluid of claim 31 wherein the polyaniline is prepared from a mixture of aniline and up to about 50% by weight of a pyrrole.

33. The electrorheological fluid of claim 1 also containing at least one organic polar compound selected from the group consisting of amines, amides, nitriles, alcohols, polyhydroxy compounds, and ketones.

34. The electrorheological fluid of claim 33 wherein the organic polar compound is a polyhydroxy compound.

35. The electrorheological fluid of claim 1 also containing at least one surfactant.

36. A non-aqueous electrotheological fluid which comprises a hydrophobic liquid continuous phase and from about 15 to about 40% by weight of at least one dispersed particulate phase of a polyaniline prepared by the steps of (a) polymerizing aniline by the use of about 1 to about 2.0 moles of a persulfate oxidizing agent and from about 0.8 to about 1.2 moles of hydrochloric acid per mole of aniline, wherein the oxidizing agent is added to the aniline and the hydrochloric acid, to form a hydrochloric acid salt of the polyaniline, and thereafter, (b) treating the hydrochloric acid salt with an amount of ammonium or sodium hydroxide, or a sodium alkoxide for a period of time sufficient to remove at least a portion of the acidic protons therefrom.

37. The electrorheological fluid of claim 36 wherein the persulfate is a metal or ammonium persulfate.

38. The electrorheological fluid of claim 36 wherein the hydrochloric acid salt of polyaniline is treated with ammonium or sodium hydroxide for a period of time sufficient to reduce the chloride content of the polyaniline to between 0 to 0.2%.

39. The electrorheological fluid of claim 38 wherein the polyaniline thus obtained is treated with a mineral acid in an amount sufficient to form a salt having the desired level of conductivity.

40. The electrorheological fluid of claim 39 wherein the mineral acid is hydrochloric acid.

41. The electrorheological fluid of claim 38 wherein the polyaniline thus obtained is treated with iodine in amounts sufficient to form a compound having the desired level of conductivity.

42. The electrorheological fluid of claim 38 wherein the polyaniline thus obtained is treated with a Lewis acid in amounts sufficient to form a product having the desired level of conductivity.

43. The electrorheological fluid of claim 36 also containing at least one organic polar compound selected from the group consisting of amines, amides, nitriles, alcohols, polyhydroxy compounds, and ketones.

44. The electrorheological fluid of claim 43 wherein the polar compound is a polyol.

45. The electrorheological fluid of claim 36 also containing at least one surfactant.

46. The electrorheological fluid of claim 1 wherein the polyaniline is prepared in the presence of a solid substrate.

47. The electrorheological fluid of claim 46 wherein the solid substrate is cellulose or a zeolite.

48. The electrorheological fluid of claim 36 wherein the polyaniline is prepared in the presence of a solid substrate.

49. The electrorheological fluid of claim 48 wherein the solid substrate is cellulose or a zeolite.

50. A clutch, valve or damper containing the electrorheological fluid of claim 1.

51. A clutch, valve or damper containing the electrorheological fluid of claim 16.

52. A clutch, valve or damper containing the electrorheological fluid of claim 37.

53. The electrorheological fluid of claim 1 wherein the hydrophobic liquid phase is an ester.

54. The electrorheological fluid of claim 46 wherein the solid substrate is cellulose.

55. The electrorheological fluid of claim 48 wherein the solid substrate is cellulose.

* * * * *

UNITED STATES PATENT AND TRADEMARK OFFICE

CERTIFICATE OF CORRECTION

PATENT NO. : 5,437,806
DATED : Aug. 1, 1995
INVENTOR(S) : Bryant et al.

It is certified that error appears in the above-indentified patent and that said Letters Patent is hereby corrected as shown below:

In claim 1, column 26, at line 37, correct the word "electrotheological" to read --electrorheological--

In column 26 at line 38, correct the expression "hydrophobia;" to read --hydrophobic--.

Signed and Sealed this

Sixteenth Day of April, 1996

Bruce Lehman

*Attest:*

BRUCE LEHMAN

*Attesting Officer*

*Commissioner of Patents and Trademarks*